US008567834B2

(12) United States Patent
Bergström

(10) Patent No.: US 8,567,834 B2
(45) Date of Patent: Oct. 29, 2013

(54) SYNCHRONIZATION OF SPREADER TWIST-LOCKS IN TWIN LIFT OPERATIONS

(75) Inventor: Jörgen Bergström, Kungsängen (SE)

(73) Assignee: Bromma Conquip Aktiebolag (SE)

( * ) Notice: Subject to any disclaimer, the term of this patent is extended or adjusted under 35 U.S.C. 154(b) by 731 days.

(21) Appl. No.: 12/297,835

(22) PCT Filed: Apr. 10, 2007

(86) PCT No.: PCT/EP2007/053466

§ 371 (c)(1),
(2), (4) Date: Dec. 3, 2010

(87) PCT Pub. No.: WO2007/122101

PCT Pub. Date: Nov. 1, 2007

(65) Prior Publication Data

US 2011/0062733 A1 Mar. 17, 2011

(30) Foreign Application Priority Data

Apr. 20, 2006 (EP) ..... 06112803

(51) Int. Cl.
*B66C 1/66* (2006.01)

(52) U.S. Cl.
USPC ..... 294/81.21; 294/81.53

(58) Field of Classification Search
USPC ..... 294/81.2, 81.21, 81.1, 81.53, 81.4
See application file for complete search history.

(56) References Cited

U.S. PATENT DOCUMENTS

| | | | | |
|---|---|---|---|---|
| 3,767,250 | A * | 10/1973 | Ward | 294/81.21 |
| 3,770,309 | A * | 11/1973 | Merchant et al. | 294/81.21 |
| 3,868,139 | A * | 2/1975 | Drelicharz | 294/81.4 |
| 4,093,090 | A * | 6/1978 | Whiteman | 294/81.2 |
| 4,215,892 | A * | 8/1980 | Holmes | 294/81.21 |
| 4,630,855 | A * | 12/1986 | Bjurling | 294/81.21 |
| 5,280,980 | A | 1/1994 | Coatta | |
| 6,145,903 | A * | 11/2000 | Stinis | 294/81.21 |
| 6,312,212 | B1 * | 11/2001 | Burlew, Jr. | 414/723 |
| 8,251,417 | B2 * | 8/2012 | Mills | 294/81.1 |
| 2003/0168871 | A1 * | 9/2003 | Geis | 294/81.21 |

FOREIGN PATENT DOCUMENTS

| | | |
|---|---|---|
| WO | 97/39973 | 10/1997 |
| WO | 03/099699 A1 | 12/2003 |
| WO | 03/104132 A | 12/2003 |

* cited by examiner

*Primary Examiner* — Paul T Chin
(74) *Attorney, Agent, or Firm* — Pepper Hamilton LLP

(57) ABSTRACT

A spreader includes inner and outer locks connectable to the corner castings of a single container and to two containers connectable in twin relation to the spreader. The outer lock is carried in pairs in the ends, respectively, of extendable beams telescopically supported in a main beam. The inner lock is moveable in pairs on the main beam exterior. In each set of associated pairs of inner and outer locks, the pair of inner locks is operable for displacement through a second drive which is separate from a first drive that is operative for displacement of the outer lock through extension or retraction of the extendable beam.

11 Claims, 3 Drawing Sheets

SYNCHRONIZATION OF SPREADER TWIST-LOCKS IN TWIN LIFT OPERATIONS

CROSS-REFERENCE TO RELATED APPLICATIONS

This application claims the priority benefit of International Patent Application PCT/EP2007/053466 with an International Filing Date on Apr. 10, 2007 with subsequent publication as International Publication Number WO 2007/122101 on Nov. 1, 2007. PCT/EP2007/053466, in turn, claims priority to European Patent Application No. 06112803.9, filed Apr. 20, 2006. The disclosures of each of the aforementioned patent documents are incorporated herein by reference in their entirety.

BACKGROUND

1. Technical Field

The present invention relates to spreaders which are connectable to a single container in single lift operations and optionally to two containers connectable to the spreader in end facing relationship in twin lift operations. More specifically, the invention refers to a spreader wherein the concurrent displacements of locking means are synchronized in twin lift operations, without the need for a mechanical connection between associated locking means. In accordance herewith, the invention also relates to a method for synchronizing the concurrent displacements of inner and outer locking means in a spreader during twin lift operations.

2. Background and Prior Art

In the field of container handling in ports and freight yards, rising demands for efficiency and reduced loading/unloading times lead the development towards spreaders with capacity for the simultaneous lift of two 20-feet containers, while the capacity for single lift needs to be maintained. The spreaders adapted for single/twin operation conventionally are equipped with outer locking means carried in the ends of extendable beams telescopically supported in a main beam, while inner locking means are supported on the main beam and controllable between an operative position allowing twin lift, and a non-operative position allowing single lift operation. As used herein, the expression "twin lift operation" shall be understood as an operation wherein two containers are handled simultaneously by the spreader, while the containers are aligned with the end walls thereof facing each other. In twin lift operations, the distance between inner and outer locking means is adjustable and determined by the length of the container, or more precisely, by the center-to-center distance between connection holes in each corner of the container, the corner castings.

Additionally, in twin lift operations, there is a frequent need to adjust internally the distance between the two sets of locking means on the spreader with respect to a spacing between the two containers to be handled. Obviously, upon connecting, a synchronization of the relative position between inner and outer locking means in both sets of locking means is necessary for an accurate lowering into the corner castings of the container. Likewise, a synchronized displacement of outer and inner locking means is necessary in lifting/lowering movements while adjusting the spacing between the two containers in a length direction.

Synchronization is conventionally provided through a controllable mechanical connection connecting the inner locking means to the extendable beam, this way urging the inner locking means to move synchronously with the outer locking means in extension/retraction motion. The mechanical connection between outer locking means/extendable beam and inner locking means may be realized in the form of a latch that is hydraulically powered and controllable to engage a belt or chain drive which operates the extendable beams in extension/retraction movements. Other solutions may include a link member, eventually comprising a hydraulic cylinder, by which the inner locking means are connectable to the beam. Examples of prior art in this connection may be found in WO 03/099699 and WO 97/39973, for example.

Typically, the spreader's extendable beams are hydraulically powered in telescopic movements. While hydraulic power thus conventionally is present on the spreader for this purpose, also other moving elements on the spreader, such as the inner locking means and the controllable mechanical links for synchronization of motions, are conveniently operated through hydraulic power, as are the lowering and raising motions of the flipper arms and the lock/unlock rotation of the locking means' twist-locks.

However there is an increasing desire, not the least driven by environmental demands, to depart from the use of oil in ports and in freight yards as well. The implementation of environmentally clean power on spreaders includes the use of electricity and electric drive means. In the course of arriving at an all-electric spreader design, several issues need to be addressed in order to achieve reasonable power consumption and, consequently, reasonable dimensions and weight in motors and transmissions.

SUMMARY OF THE INVENTION

The present invention aims to address one or several of the problems which are faced in connection with the design of spreaders for single/twin lift operation, and especially in connection with all-electrically powered spreaders.

In a central aspect thereof, the present invention provides an extendable spreader for single/twin lift operations wherein outer and inner locking means are synchronized in movements longitudinally of the spreader without being linked mechanically. This aspect of the invention is specifically advantageous in all-electrically powered spreaders.

The object is met in a spreader as specified in accompanying claims. A spreader according to the present invention comprises, briefly, outer and inner locking means which are connectable to the corner castings of a single container and optionally to two containers connectable in twin to the spreader, the outer locking means carried in pairs in the ends, respectively, of extendable beams telescopically supported in a main beam, and the inner locking means movable in pairs on the main beam exterior, wherein, in each set of associated pairs of outer and inner locking means, the pair of inner locking means is operable for displacement in the length direction of the spreader through a second drive means which is separate from a first drive means operative for displacement of the outer locking means through extension/retraction of the extendable beam. The claimed invention advises that the first and second drive means are individually powered and separately operated through a control system that synchronizes the concurrent displacements of the outer and inner locking means without a mechanical connection being arranged between associated pairs of outer and inner locking means in extension/retraction movements.

The control system comprises detector means and power control means controlling the power supply to the first and second drive means in result of a continuous detection of displacement positions or/and displacement velocities of the outer and inner locking means, respectively. The control system and power control means may be arranged to adjust individually the operation of each said first and second drive means in result of a detected relative position or/and relative velocity of the outer and inner locking means. To this purpose, length measurement devices may be supported on the spreader main beam, arranged to cooperate with reflector devices on the locking means and effective for continuously monitoring the positions of the outer and inner locking means during displacements.

In a preferred embodiment, the first and second drive means each has a power output shaft, each output shaft being associated with a sensor detecting at each time a rotary position or/and rotational velocity of the associated output shaft, and the control system comprising a processor comparing the relative positions or/and relative velocities of the output shafts, and the power control means adjusting the rotary speeds of each output shaft individually in result of a detected difference in rotary position or/and rotational velocity. Advantageously, the control system is arranged to reduce, at each occasion, the speed of the fastest rotating output shaft.

In electrically operated spreaders, the invention foresees that the first and second drive means are electrically powered via AC frequency regulators controlling the rotary speeds of the output shafts in synchronization by adjusting the frequency in power supply individually to the first and second drive means. In connection with asynchronous drives, e.g., the control system may further comprise a current control by which current supply is adjusted in result of detected power consumption at the output shafts.

The invention is advantageously applied to a spreader wherein the second drive means comprises a motor driving an endless member running about a power output shaft and an idler roller, a first pair of inner locking means connected to an upper part of the endless member and a second pair of inner locking means connected to a lower part of the endless member. Likewise, the first drive means advantageously comprises a motor driving an endless member running about a power output shaft and an idler roller, a first pair of outer locking means connected to an upper part of the endless member via a first extendable beam, and a second pair of outer locking means connected to a lower part of the endless member via a second extendable beam.

In an all-electric spreader design realizing the invention, the spreader further comprises electrically operated flipper arms and twist locks. In accordance with the above, the invention also teaches a method for synchronizing the concurrent displacements of associated outer and inner locking means in longitudinal directions of a spreader designed for single and twin lift operations, comprising the steps of feeding power individually to separate first and second drive means that are operative for displacement of the outer and inner locking means, respectively, and controlling the power supplies to the first and second drive means for synchronized displacements without connecting mechanically the associated outer and inner locking means.

The method of the invention comprises the step of controlling the power supply to the first and second drive means in result of a continuous detection of displacement positions or/and displacement velocities of outer and inner locking means.

Advantageously, the method further comprises the step of adjusting individually the power supply to the first and second drive means in result of a detected relative position or/and relative velocity of the outer and inner locking means. Detection of displacement position may alternatively comprise the step of monitoring the positions of the outer and inner locking means through length measurement during displacements. Preferably though, the method comprises the step of detecting at each time the rotary positions or/and rotational velocities of power output shafts of the first and second drive means, comparing the relative positions or/and relative velocities of the output shafts, and adjusting the rotary speeds of each output shaft individually in result of a detected difference in rotary position or/and rotational velocity.

In electrically operated spreaders, the method advantageously comprises the step of providing AC-powered first and second drive means, and controlling the rotary speeds of the output shafts in synchronization by adjusting the frequency in power supply to the first and second drive means through separate AC frequency regulators, feeding individually the first and second drive means. In this embodiment, synchronization may comprise the step of reducing, at each occasion, the speed of the fastest rotating output shaft until synchronization of displacement is reestablished. In connection with asynchronous drives, the method may further comprise the step of controlling the current supply in result of detected current consumption at the output shafts.

Further details and advantages of the invention will appear from the detailed description given below, the separate features of which may be applied individually or in different combinations while still taking advantage of the invention.

BRIEF DESCRIPTION OF THE DRAWINGS

In the following, the invention will be more closely explained in connection to the drawings, illustrating schematically the invention as realized through examples thereof. In the drawings, FIG. 1 schematically illustrates a spreader design in a side view.

DETAILED DESCRIPTION

Notwithstanding the diagrammatic representations of FIGS. 1-4, the spreader producing industry and persons skilled in the art will certainly be capable to apply the teachings set forth below in various mechanical designs for crane operated spreaders. Thus, the detailed spreader mechanics is left out from the drawings and disclosure, on one hand in consideration of the invention being applicable in various spreader designs, and on the other hand in view of the invention, which is concerned with the control of synchronized locking-means displacements in a spreader arranged for single/twin lift operations, being practicable by the suggested combination and implementation of equipment that is available and known from other industrial areas and for other purposes.

Figure 1:
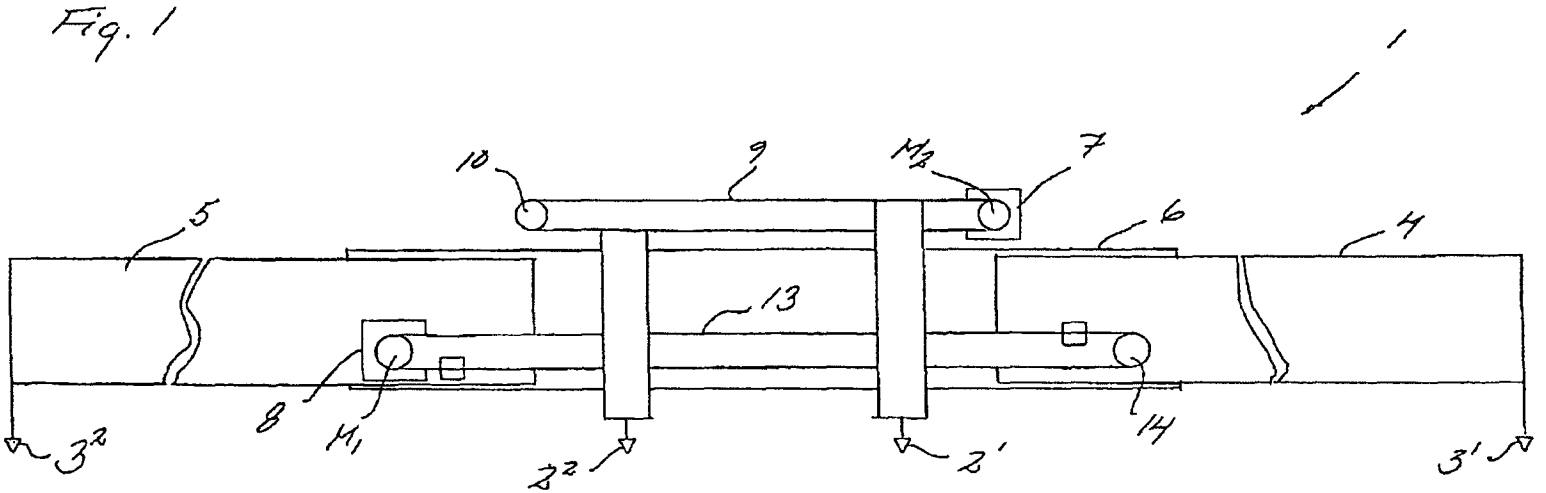
Figure 2:
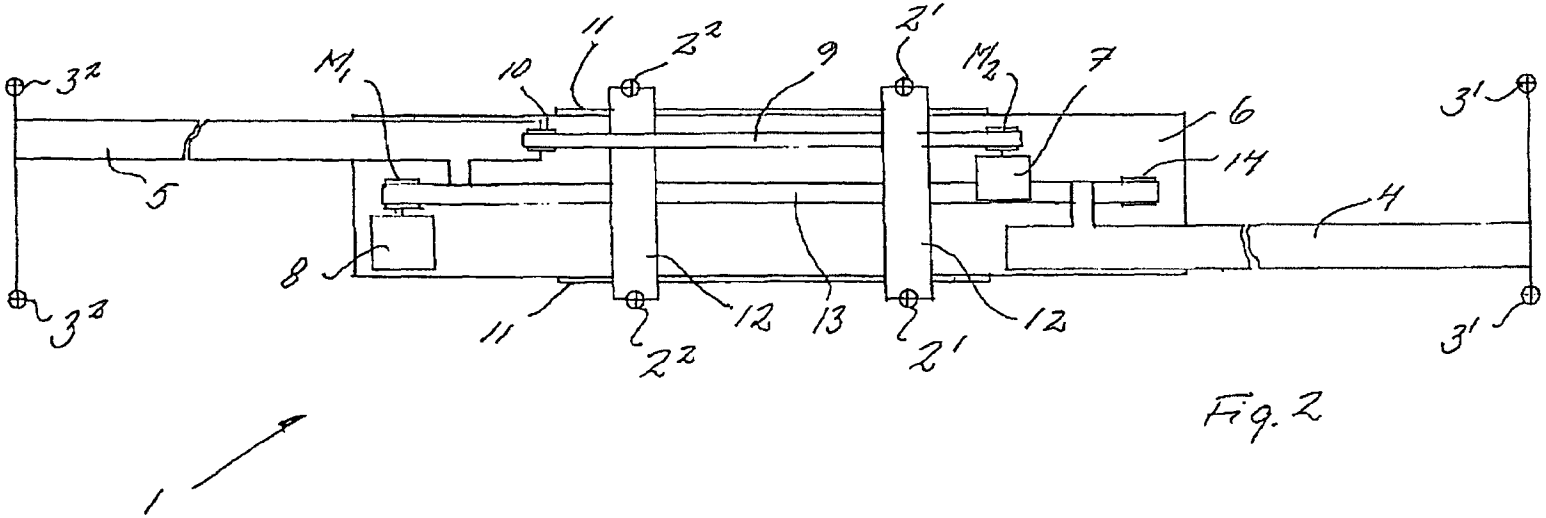
FIG. 2 is a schematic top view of the spreader of FIG. 1.

With reference to FIGS. 1 and 2, reference number 1 denotes a spreader adapted for single/twin lift operations, and which is typically suspended from a crane and operated in lifting/lowering movements through crane cables that connect to sheaves rotatable in a head-block (not shown) situated on top of the spreader main beam. The spreader 1 comprises inner locking means 2 and outer locking means 3, connectable to the corner castings of a single container and optionally to two containers connectable in twin to the spreader 1 (containers not being illustrated in the drawings). The locking means 2 and 3 typically include rotatable heads that are insertable into the corner castings and lockable thereto through a 90° rotation, so called twist-locks. The outer locking means 3 are carried in pairs in the ends, respectively, of extendable beams 4 and 5 that are telescopically supported in a main beam 6 and driven for extension/retraction movements relative to the main beam.

The inner locking means 2 are movable in pairs on the main beam exterior. In each set of associated pairs of inner and outer locking means 2 and 3, the pair of inner locking means is operable for displacement in the length direction of the spreader through a second drive means 7 which is separate from a first drive means 8 operative for displacement of the outer locking means 3 through extension/retraction of the extendable beams 4 and 5, respectively.

In single lift operations, the inner locking means 2 are moved, such as through pivoting or lifting, to a non-operative position above the top plane of a container connectable to the spreader. Connection is realized through the outer locking means alone upon retraction of the extendable beams 4 and 5 to match the length of the single container. In twin lift operations, the extendable beams 4 and 5 are extended to the combined length of the two containers positioned in twin, while the inner locking means are lowered into operative position for connection to the innermost corner castings of the two containers. In twin lift operations, the inner and outer locking means in each set of locking means are concurrently displaceable in synchronization, as required in order to adapt the spreader and the sets of associated outer and inner locking means to a spacing existing between the two containers, or in order to adjust that spacing during lifting or lowering of the containers.

According to the invention, the concurrent displacement of the inner and outer locking means 2 and 3 is synchronized without a mechanical connection being arranged between associated pairs of inner and outer locking means in extension/retraction movements. To this purpose, the first and second drive means 7 and 8, respectively, are both connected to and operated through a control system as will be further explained below.

Synchronization is achieved based on the continuous detection of driven displacements of inner and outer locking means, in result of which the control system controls the operation of the first and second drive means. Specifically, the control system is arranged to adjust individually the operation of each said first and second drive means in result of a detected displacement position or/and displacement velocity of the outer and inner locking means. The positions or/and velocities of the outer and inner locking means during displacements may be continuously monitored through optical length measurement or sound ranging, such as realized through laser or ultrasonic range finders, e.g., supported on the main beam and cooperating with reflectors carried on the locking means. In a preferred embodiment of the invention, however, displacements are driven through rotational shafts and synchronization is based on detection of rotary position or/and rotational velocity in the shafts, as will be further explained below.

Returning to the drawings 1 to 4 each said first and second drive means comprises a motor and transmission, including a power output shaft M1 and M2, respectively. Via the output shaft $M_2$, the second drive means 7 drives an endless member 9, such as a chain or belt, engaged by the output shaft $M_2$ and running about an idler roller 10. A first pair of inner locking means $\mathbf{2}^1$ is connected to an upper part of the endless member 9, and a second pair of inner locking means $\mathbf{2}^2$ is connected to a lower part of the endless member 9. Thus, when the output shaft $M_2$ is operated in a first direction of rotation, the endless member moves the pairs of inner locking means in mutually opposite directions while reducing, or increasing as the case may be, the intermediate distance between the pairs of inner locking means. Operating the output shaft in the opposite direction of rotation results in the reverse.

Upon displacement, the inner locking means 2 travel in guides 11 supported on the main beam exterior. The inner locking means are interconnected in pairs through an interconnecting member 12, such as a rigid arm, as illustrated schematically. In a similar way, the first drive means 8 drives an endless member 13 engaged by the output shaft $M_1$ and running about an idler roller 14. A first pair of outer locking means $\mathbf{3}^1$ is connected to an upper part of the endless member via a first extendable beam 4, and a second pair of outer locking means $\mathbf{3}^2$ is connected to a lower part of the endless member via a second extendable beam 5. Thus, when the output shaft $M_1$ is operated in a first direction of rotation for extension of the beams 4 and 5, the endless member 13 effects a displacement of the pairs of outer locking means in mutually opposite directions while increasing the intermediate distance there between. Operating the output shaft $M_1$ in the opposite direction of rotation results in the reverse, upon retraction of the beams 4 and 5.

It will be appreciated by persons skilled in the art of spreader design, that extension/retraction movements and displacements of outer and inner locking means may be carried out in other ways than that described, without departing from the invention which is focused on the synchronized displacements in twin lift operations without the need for a mechanical connection between outer and inner locking means. For example, gear racks or helical racks may be arranged in exchange for the endless member, if appropriate.

Figure 3:
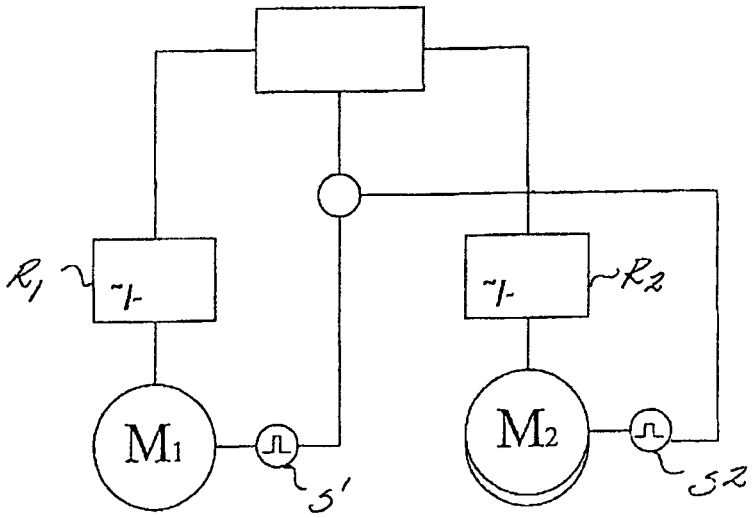
FIG. 3 is a block diagram schematically illustrating the synchronized displacement control of inner and outer locking means.
Figure 4:
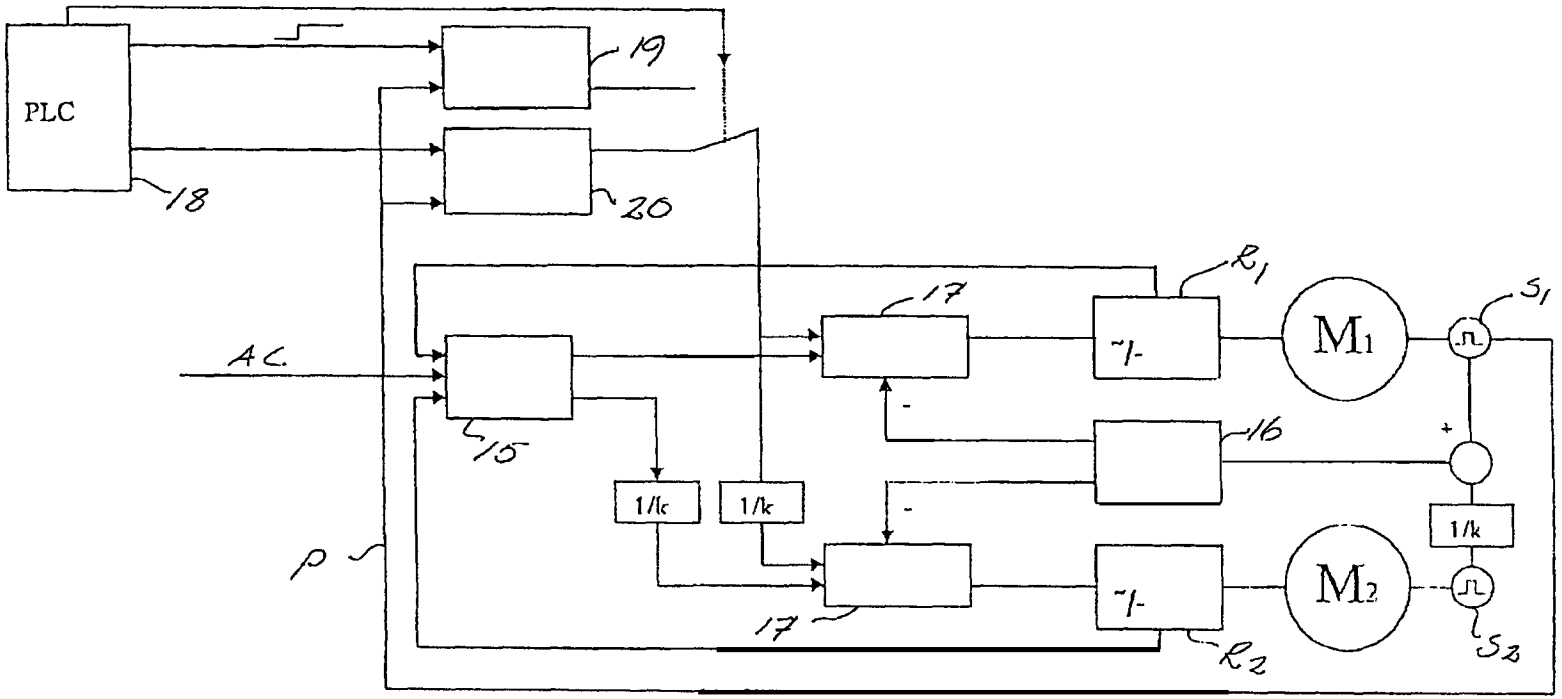
FIG. 4 is a block diagram showing the synchronization control in more detail.

The operation of the first and second drive means and output shafts $M_1$ and $M_2$ is synchronized through a control system as illustrated in FIGS. 3 and 4. Each output shaft $M_1$ and $M_2$ is associated with a sensor $S_1$ and $S_2$, respectively, detecting at each time a rotary position or/and rotational velocity of the associated output shaft.

The sensors $S_1$ and $S_2$ may be conventional rotary encoders connected to the output shafts, e.g. The rotary positions/velocities are compared, and in case of a detected difference in rotary position/velocity, synchronization is re-established by regulating the feed of power individually to the output shafts, through power regulators $R_1$ and $R_2$, respectively.

Thus, the displacements of the outer and inner locking means in extension and retraction movements is continuously detected, and the operations of the first and second drive means, represented by output shafts $M_1$ and $M_2$, respectively, are individually adjusted in result of a detected difference in displacements of the outer and inner locking means. The general concept laid out above would be applicable in connection with hydraulic, or pneumatic, or even combustion power if appropriate. However, in the course of arriving at environmentally safe technology, the present invention specifically advises the use of electric power in both first and second drive means 7 and 8.

Accordingly, in a preferred embodiment of the invention, the output shafts M1 and M2 are electrically powered via AC frequency regulators $R_1$ and $R_2$, respectively, effective for adjusting the frequency of supplied power individually to electric motors of the first and second drive means in result of a detected difference in rotary positions or/and rotational velocities. Preferably, the control system is arranged to execute a reduction, at each occasion, of the AC frequency and speed of the fastest rotating output shaft, this way avoiding an acceleration of the rotary speeds.

With reference to FIG. 4, a control system effective for synchronization of the displacements of the outer and inner locking means in an all electric spreader design is illustrated by way of example. From the left hand side of the drawing, AC power is supplied from a current control device 15 to the first and second drive means, here represented by output shafts $M_1$ and $M_2$, via frequency regulators $R_1$ and $R_2$, respectively.

The rotary positions of the output shafts, or/and the rotational velocities in the alternative, are continuously detected through the sensors $S_1$ and $S_2$, the readings of which are reported to and compared in a processor 16, such as a Proportional/Integral-regulator 16. From the processor 16, a detected error in synchronization is transferred to the power controls 17, controlling individually the operation of the frequency regulators $R_1$ and $R_2$. A deviation in rotary position or/and rotational velocity thus results in a command in the power controls 17, effecting a corresponding actuation of the frequency regulators $R_1$ and $R_2$. Preferably, the fastest running drive is slowed down until synchronization is re-established.

In the case of asynchronous drives, current feedback is advantageously provided from the regulators $R_1$ and $R_2$ to the current control device 15. Thus, power feed may be dimensioned based on detected current consumption and utilized for optimizing the velocity, such as in spreader switchover between single and twin operation, or in container positioning during lift.

Operator control is provided through the PLC-unit 18 situated on-board the spreader and communicating with the operator, conventionally through wires or optionally through a wireless communication. In the PLC, reference values representing synchronized positions and/or velocities for outer and inner locking means may be stored, and called upon by the operator for effectuation through the control system. System sub-controls 19 and 20 are integrated for intervention on command from the PLC, or based on feedback on velocity or/and position received from the control system as suggested through the arrowed line P running from sensor $S_1$ detecting rotary position or/and rotational velocity of output shaft $M_1$, effective for displacement of the outer locking means. In the drawing, the symbol 1/k represents a constant determined by different gear ratio between the first and second drives.

In an all-electric spreader design also the flipper arms (not shown), carried in the ends of the extendable beams and which effect a correct positioning of the spreader upon lowering for connection to a container, are electrically driven, as is the lock/unlock-rotation of the twist-locks that effect connection/disconnection to the container.

Through the synchronization control described, a spreader for single/twin lift operations is designed to have reduced weight and low power consumption, above the advantage of environmentally safe power supply in an all-electrical spreader design.

The invention claimed is:

1. A spreader comprising:

outer locks, each configured to be connectable to a corner casting of a single container or an outer corner casting of one of two containers connectable in twin relation to the spreader, the outer locks carried in pairs at respective ends of one or more extendable beams telescopically supported in a main beam, and inner locks, each configured to be connectable to an inner corner casting of one of two containers connectable in twin relation to the spreader, the inner locks movable in pairs on a main beam exterior, wherein, in each set of associated pairs of the inner and outer locks, the pair of inner locks is operable for displacement through a second drive which is separate from a first drive that is operative for displacement of the outer locks through one or more of the following: extension and retraction of the one or more extendable beams, characterized in that the first and second drives are individually powered and separately operated through a control system that is configured to synchronize concurrent displacements of the outer and inner locks without a mechanical connection being arranged between associated pairs of outer and inner locks in one or more of the following: extension movements and retraction movements.

2. The spreader of claim 1, wherein the control system comprises a detector and a power control configured to control the power supply to the first and second drives in result of one or more of the following: a continuous detection of displacement positions of the outer and inner locks and a continuous detection of displacement velocities of the outer and inner locks.

3. The spreader of claim 2, wherein the control system and power control are arranged to adjust individually operation of each of the first and the second drives in result of one or more of the following: a detected relative position of the outer and inner locks and a relative velocity of the outer and inner locks.

4. The spreader of claim 1, wherein one or more length measurement devices are supported on the spreader main beam, arranged to cooperate with reflector devices on the outer and inner locks and effective for continuously monitoring positions of the outer and inner locks during displacements.

5. The spreader of claim 1, wherein the first and second drives each has a power output shaft, each output shaft being associated with a sensor configured to detect one or more of the following: a rotary position and a rotational velocity of an associated output shaft, and the control system further comprising a processor reading one or more of the following: relative positions of the output shafts and relative velocities of the output shafts, and the power control configured to adjust rotary speeds of each output shaft individually in result of a detected difference in one or more of the following: rotary position and rotational velocity.

6. The spreader of claim 5, wherein the first and second drives are electrically powered via respective AC frequency regulators configured to control the rotary speeds of the output shafts in synchronization by adjusting a frequency in power supply individually to the first and second drives.

7. The spreader of claim 6, wherein the control system is arranged to reduce the rotary speed of the fastest rotating output shaft.

8. The spreader of claim 6, wherein the control system further comprises a current control by which a current supply is adjusted in result of detected power consumption at the output shafts.

9. The spreader of claim 1, wherein the second drive means comprises a motor configured to drive an endless member running about a power output shaft and an idler roller, a first pair of inner locks connected to an upper part of the endless member and a second pair of inner locks connected to a lower part of the endless member.

10. The spreader of claim 1, wherein the first drive comprises a motor configured to drive an endless member running about a power output shaft and an idler roller, a first pair of outer locks connected to an upper part of the endless member via a first extendable beam, and a second pair of outer locks connected to a lower part of the endless member via a second extendable beam.

11. The spreader of claim 1, further comprising electrically operated flipper arms and twist locks.

* * * * *